US009429168B2

(12) United States Patent
Hsu et al.

(10) Patent No.: US 9,429,168 B2
(45) Date of Patent: Aug. 30, 2016

(54) FAN AND FRAME THEREOF

(75) Inventors: Chia-Ming Hsu, Taoyuan Hsien (TW); Shun-Chen Chang, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 2085 days.

(21) Appl. No.: 12/109,910

(22) Filed: Apr. 25, 2008

(65) Prior Publication Data

US 2008/0292453 A1 Nov. 27, 2008

(30) Foreign Application Priority Data

May 25, 2007 (TW) ..... 96118685 A

(51) Int. Cl.
*F04D 29/54* (2006.01)
*F04D 25/06* (2006.01)

(52) U.S. Cl.
CPC ..... *F04D 29/542* (2013.01); *F04D 25/0613* (2013.01)

(58) Field of Classification Search
CPC ..... F04D 29/542; F04D 25/0613
USPC ..... 415/211.2, 208.1
See application file for complete search history.

(56) References Cited

U.S. PATENT DOCUMENTS 5,577,888 A * 11/1996 Capdevila et al. ..... 415/210.1
6,981,843 B2 * 1/2006 Chiu et al. ..... 415/220
7,220,102 B2 * 5/2007 Cho et al. ..... 415/211.2
7,238,004 B2 * 7/2007 Lin et al. ..... 415/199.4
7,988,407 B2 * 8/2011 Hsu et al. ..... 415/77
8,029,236 B2 * 10/2011 Chang et al. ..... 415/199.5
8,035,967 B2 * 10/2011 Oh ..... 361/695
2008/0193287 A1 * 8/2008 Kobayashi et al. ..... 415/208.2
2008/0219837 A1 * 9/2008 Chang et al. ..... 415/182.1

FOREIGN PATENT DOCUMENTS

CN 2679401 * 2/2005

OTHER PUBLICATIONS

Chen, Commutation coupler structure of series steering axial fan, Feb. 16, 2005, abstract of CN2679401.*

* cited by examiner

*Primary Examiner* — Dwayne J White

(74) *Attorney, Agent, or Firm* — Muncy, Geissler, Olds & Lowe, P.C.

(57) ABSTRACT

A fan includes a frame and an impeller. The frame includes a main body, a plurality of guiding elements and a motor base. The main body has an airflow inlet and an airflow outlet. The guiding elements are disposed in the main body and located at the airflow outlet, wherein each of the guiding elements includes an inclined part and an axial extended part, and the inclined par meets the axial extended part at an angle. The motor base connects to the main body. The impeller is disposed on the motor base for providing an airflow, wherein the guiding elements guide the airflow away from the fan.

15 Claims, 5 Drawing Sheets

FAN AND FRAME THEREOF

CROSS REFERENCE TO RELATED APPLICATIONS

This Non-provisional application claims priority under 35 U.S.C. §119(a) on Patent Application No(s). 096118685, filed in Taiwan, Republic of China on May 25, 2007, the entire contents of which are hereby incorporated by reference.

BACKGROUND OF THE INVENTION

1. Field of the Invention

The present invention relates to a fan and a frame thereof, and more particularly to a fan and a frame thereof for guiding airflow away from the fan and reducing vortex.

2. Description of the Related Art

As the performance of electronic devices continue to enhance, heat dissipating devices and heat dissipating systems are playing more critical roles within the electronic devices. Poor heat dissipation can lead to damage or failure to the electronic devices.

Heat dissipating devices play an even more important role for microelectronic elements and devices, (e.g. integrated circuit, IC). Due to the increase of integration and advancement of packaging technology, integrated circuit area keeps being reduced and heat per unit area thus keeps being increased. Thus, high efficient heat dissipating devices have been under active development by those in the field.

Referring to FIG. 1A, a cross section view of a conventional axial fan and FIG. 1B, a schematic illustration of a direction of airflow of FIG. 1A are shown. Generally, an axial fan 1 has a frame 11 and a motor base 14 which are connected to each other by several ribs 13. When an airflow f enters an airflow inlet 16 of an axial fan 1 in a vertical direction (as shown in FIG. 1B, arrow X1), an impeller 12 of the axial fan 1 rotates to change the original direction of the airflow f (as shown in FIG. 1B, arrow X2). Then the airflow f passes through the ribs 13 (as shown in FIG. 1B, arrow X3). However, the ribs 13 can not completely guide the airflow back to the vertical direction. Thus, the airflow f of the axial fan 1 exiting from the airflow outlet 17 is not in the vertical direction, as indicated by arrow X4 in FIG. 1B. The airflow f has a tangent component which causes vortex v. Therefore, loss of kinetic energy of the axial fan 1 is raised, and efficiency of heat dissipation is reduced. If more axial fans 1 are provided to achieve adequate heat dissipation effect, then costs and noise will be increased. In addition, axial fans 1 are heat sources. It requires additional energy to dissipate heat generated from the axial fans.

BRIEF SUMMARY OF THE INVENTION

To solve the problems of the conventional axial fan, the present invention provides a fan and a frame thereof, wherein airflow can be guided vertically to the airflow outlet and away from the fan. Therefore, vortex is reduced, resulting in higher heat dissipating efficiency and lower noise.

To achieve the above, the present invention discloses a frame. The frame includes a main body and a plurality of guiding elements. The main body has an airflow inlet and an airflow outlet. The guiding elements are disposed in the main body and located at the airflow outlet. Each of the guiding elements includes an inclined part and an axial extended part, and the inclined part meets the axial extended part at an angle. The guiding elements guide an airflow away from the frame by passing through the inclined part and the axial extended part in turn.

To achieve the above, the present invention discloses a fan. The fan includes a frame, and an impeller. The frame includes a main body, a plurality of guiding elements and a motor base. The main body has an airflow inlet and an airflow outlet. The guiding elements are disposed in the main body and located at the airflow outlet. Each of the guiding elements includes an inclined part and an axial extended part, and the inclined part meets the axial extended part at an angle. The impeller is disposed on the motor base for providing an airflow, and then the guiding elements guide the airflow away from the fan by passing through the inclined part and the axial extended part in turn.

For the above descriptions of the fan and the frame thereof, the angle is between 20 degrees and 50 degrees. The inclined part has a first height, the axial extended part has a second height, and a ratio of the first height and the second height is between 0.2 and 5. The sum of the first height and the second height exceeds 15 millimeters. The axial extended part parallels an axis of the frame or inclines to the axis of the frame by a clipping angle which is smaller than or equal to 20 degrees. A cross-section of the inclined part is wing shaped, arc-shaped or streamline-shaped. The inclined part and the axial extended part are integrally formed as a single piece or different components and combined to form the guiding element. The frame further includes a motor base connected to the main body via the guiding elements. The motor base has at least one protruding rib inside the motor base. The main body is substantially rectangular, rounded, elliptic, polygonal or cone-shaped.

For the above descriptions, the fan further includes a driving element installed on the motor base. The driving element rotates the impeller to form the airflow. The driving element can be a motor, and the impeller has a hub and a plurality of blades.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1A:
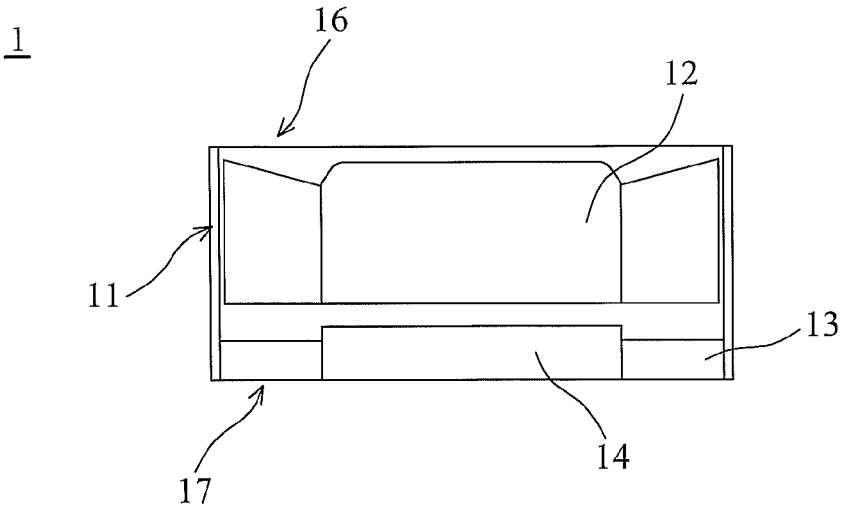
FIG. 1A (PRIOR ART)
FIG. 1A is a cross section view of a conventional axial fan.
Figure 1B:
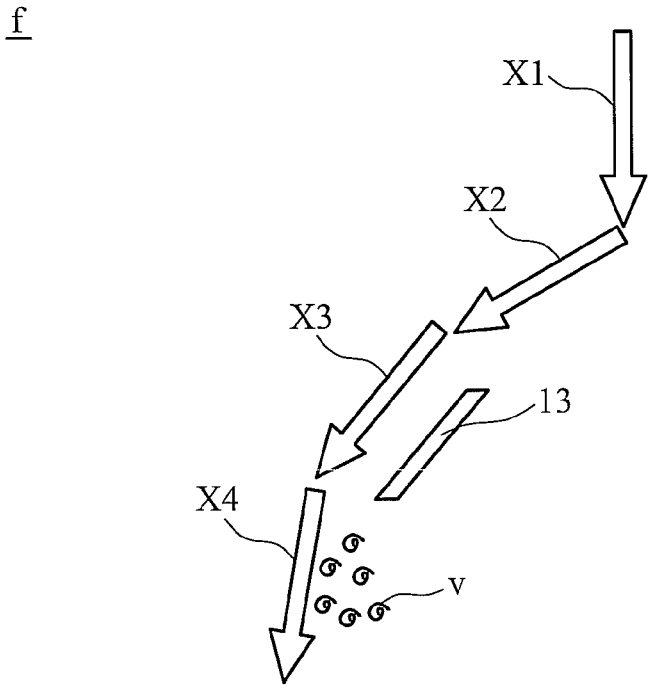
FIG. 1B (PRIOR ART)
FIG. 1B is a schematic illustration showing the direction of airflow of the conventional axial fan in FIG. 1A.
Figure 2A:
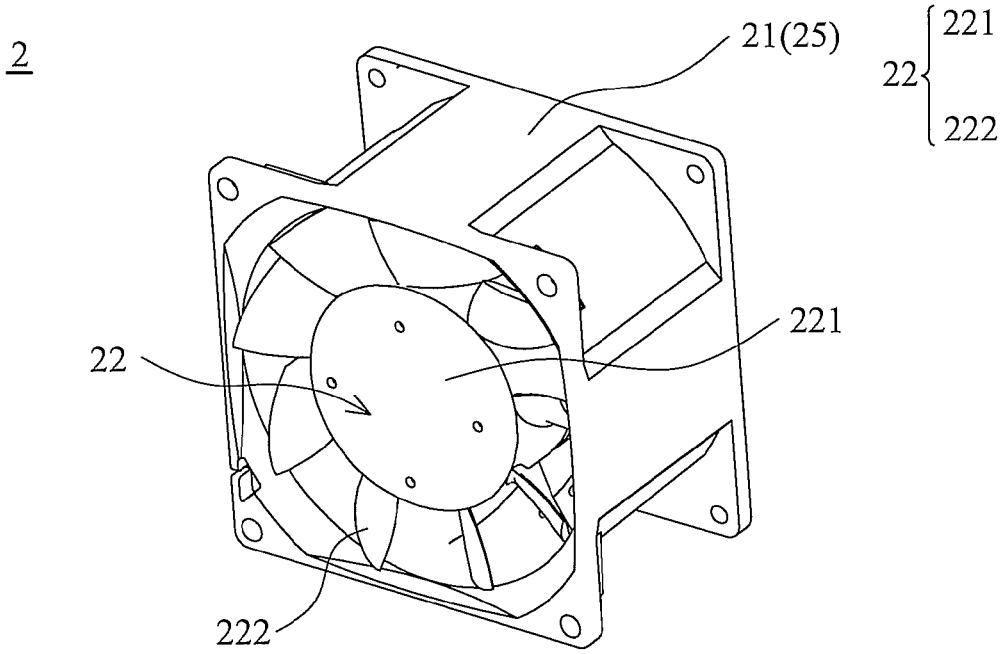
FIG. 2A is a schematic illustration of a fan in accordance with an embodiment of the present invention.
Figure 2B:
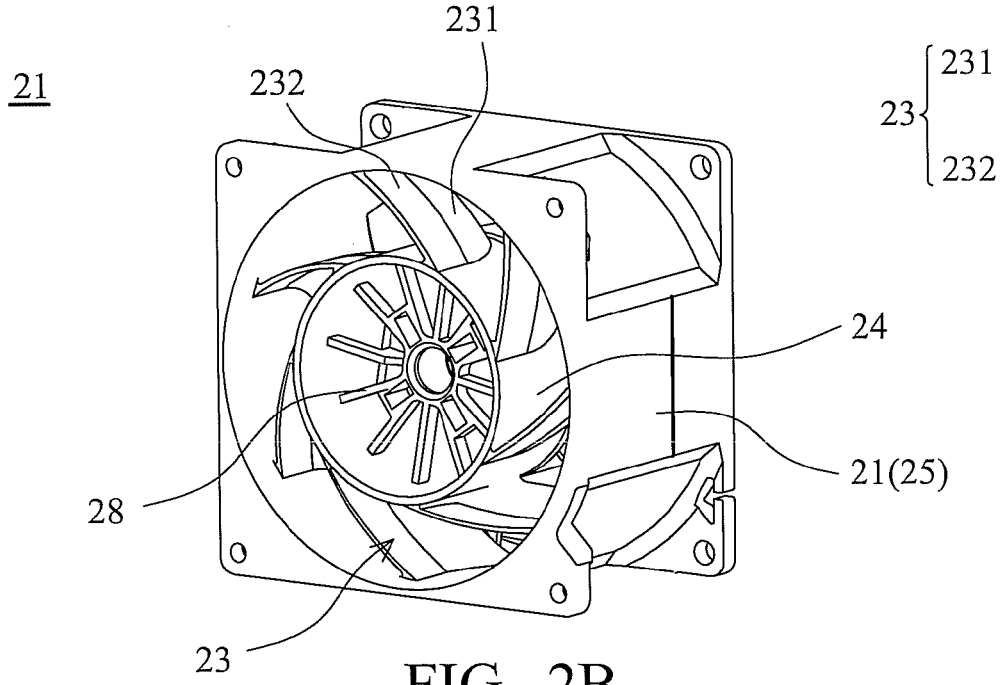
FIG. 2B is a schematic illustration of the frame of FIG. 2A.
Figure 2C:
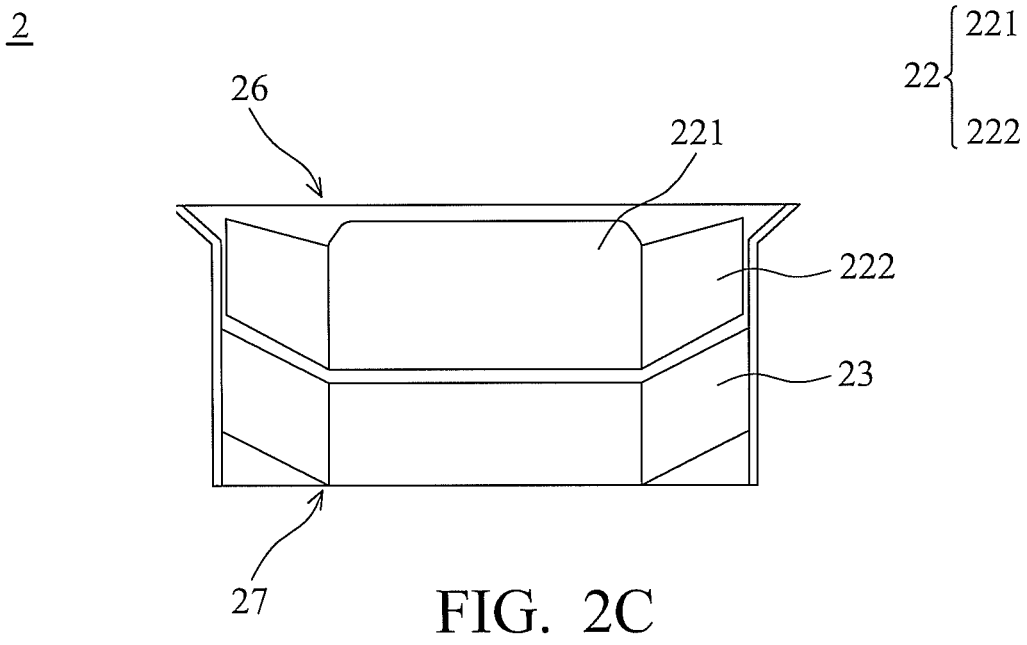
FIG. 2C is a cross section view of the fan of FIG. 2A.

Referring to FIG. 2A, a schematic illustration of a fan in accordance with an embodiment of the present invention, FIG. 2B, a schematic illustration of the frame of FIG. 2A, and FIG. 2C, a cross section view of the fan of FIG. 2A are shown. The fan 2 includes a frame 21 and an impeller 22. The frame 21 includes a main body 25, a plurality of guiding elements 23 and a motor base 24. The main body 25 has an airflow inlet 26 and an airflow outlet 27. The shape of the main body 25 can be different types depending on practical requirements. For example, the main body 25 may be substantially rectangular, rounded, elliptic, polygonal, cone-shaped or other shapes. The impeller 22 has a hub 221 and a plurality of blades 222. The motor base 24 has at least one protruding rib 28 inside the motor base 24 for increasing the structural strength of the motor base 24. The impeller 22 is disposed on the motor base 24. A driving element (e.g. motor, not shown) is also installed on the motor base 24. The driving element rotates the impeller 22 to form an airflow. Then, the guiding elements 23 guide the airflow away from the airflow outlet 27 of the fan 2.

Figure 3A:
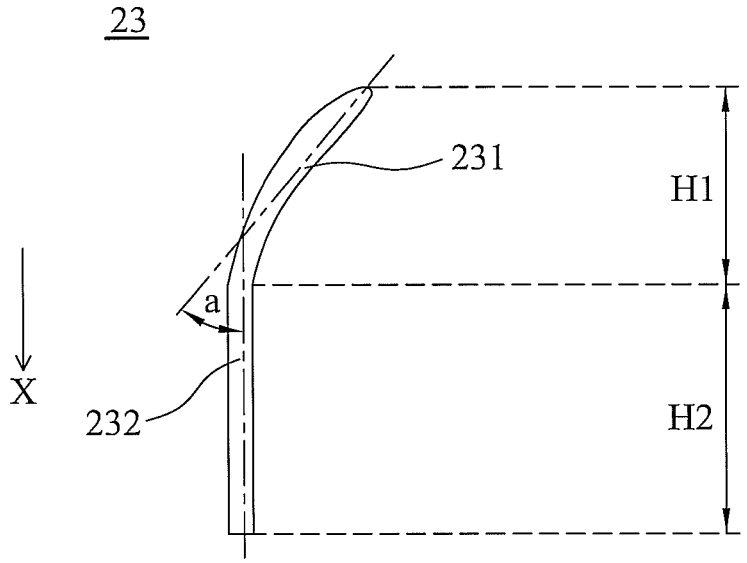
FIG. 3A is a vertical cross section view of the guiding element of FIG. 2B.

FIG. 3A is a vertical cross section view of the guiding element of FIG. 2B. Referring to FIG. 2C and FIG. 3A, the guiding elements 23 are disposed in the main body 25 and located at the airflow outlet 27. Each of the guiding element 23 includes an inclined part 231 and an axial extended part 232, and the inclined par 231 meets the axial extended part 232 at an angle "a", which is between 20 degrees and 50 degrees. The angle "a" may be changed in accordance with the characteristic of the fan 2. The axial extended part 232 can be parallel to a vertical direction "X" of the frame or incline to the axis of the frame 21 by a clipping angle which is smaller than or equal to 20 degrees. In order to allow airflow smoothly through the fan, a cross-section of the inclined part 231 is designed as wing shaped, arc-shaped or streamline-shaped. Therefore, the airflow passes through the inclined part 231, which is streamline-shaped, will reduce friction produced by airflow and decrease kinetic energy loss. Then, the airflow leaves the fan 2 after passing through the axial extended part 232. As shown in FIG. 3A, the inclined part 231 has a first height H1, the axial extended part 232 has a second height H2. If a ratio of the first height H1 to the second height H2 is between 0.2 and 5, then the guiding elements 23 can function well. Furthermore, the first height H1 of the inclined part 231 and the second height H2 of the axial extended part 232 are determined by the size of the fan 2. For example, the efficiency for a fan sized as 38*38 millimeters is optimized if the sum of the first height H1 of the inclined part 231 and the second height H2 of the axial extended part 232 exceeds 15 millimeters.

Figure 3B:
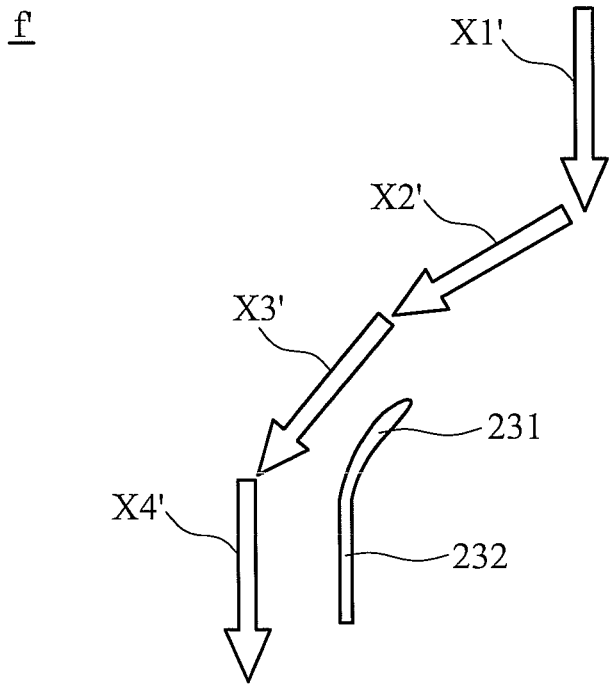
FIG. 3B is a schematic illustration showing the direction of airflow of FIG. 2A

Referring to FIG. 3B, a schematic illustration showing of the direction of airflow of FIG. 2A is shown. When the fan 2 operates, the airflow f' outside the fan 2 enters the airflow inlet 26 in a vertical direction (as shown in FIG. 3B, arrow X1'). Then, the airflow f' is guided by the blades 222 on the circumference of the hub 221 to increase its pressure and velocity. Thus, the direction of the airflow is changed (as shown in FIG. 3B, arrow X2'). The velocity of the airflow f' includes a tangent velocity component and a vertical velocity component, and the tangent velocity component and the vertical velocity component interfere with each other to form a vortex. To avoid a vortex, therefore, the position of the guiding elements 23 is arranged to comply with the direction of the airflow f', wherein the inclined angle of the inclined parts 231 is approximately equal to that of the airflow f'. Furthermore, the inclined parts 231 and the axial extended parts 232 constitute a streamlined wing structure. Thus, after passing through the inclined parts 231 of the guiding elements 23, the airflow f' can be smoothly guided to the location where the inclined part 231 and the axial extended part 232 meet. Meanwhile, the tangent velocity component of the airflow f' is partially converted into the vertical velocity component as indicated by arrow X3' in FIG. 3B. Then, the airflow f is guided by the axial extended parts 232 to completely convert the tangent velocity component into the vertical velocity component as indicated by arrow X4' in FIG. 3B. Finally, the airflow f' exits from the airflow outlet 27 of the fan 2. Thus, the vortex phenomenon of the airflow outlet 27 of the fan 2 can be completely controlled. Therefore, the pressure and velocity of the fan 2 can be increased.

The guiding elements 23 of the present invention can be implemented in various ways. For example, the guiding elements 23 are integrally formed with the frame 21 as a single piece. For another example, the guiding elements 23 are formed by combining the inclined parts 231 and the axial extended parts 232 which are two separate components before combining. Or, the axial extended parts 232 are integrally formed with the frame 21 as a single piece and then are combined to the inclined part 231 of other component. The guiding elements 23 formed by combining the inclined parts 231 of one component and the axial extended parts 232 of other component facilitate a replacement of the damaged part therefrom, and allow the manufacturers to select different inclined parts 231 and axial extended parts 232 in accordance with different shapes of impellers 22 so as to increase the heat dissipating efficiency of the fan 2. For the above design, the axial extended part 232 and the inclined part 231 can be separate components and then be assembled. It is convenient that the design not only allows the fan 2 to replace a damaging part easily but also increases flexibility of choosing of the appropriate inclined part 231 and the axial extended part 232 according to the shape of the impeller 22.

Figure 4:
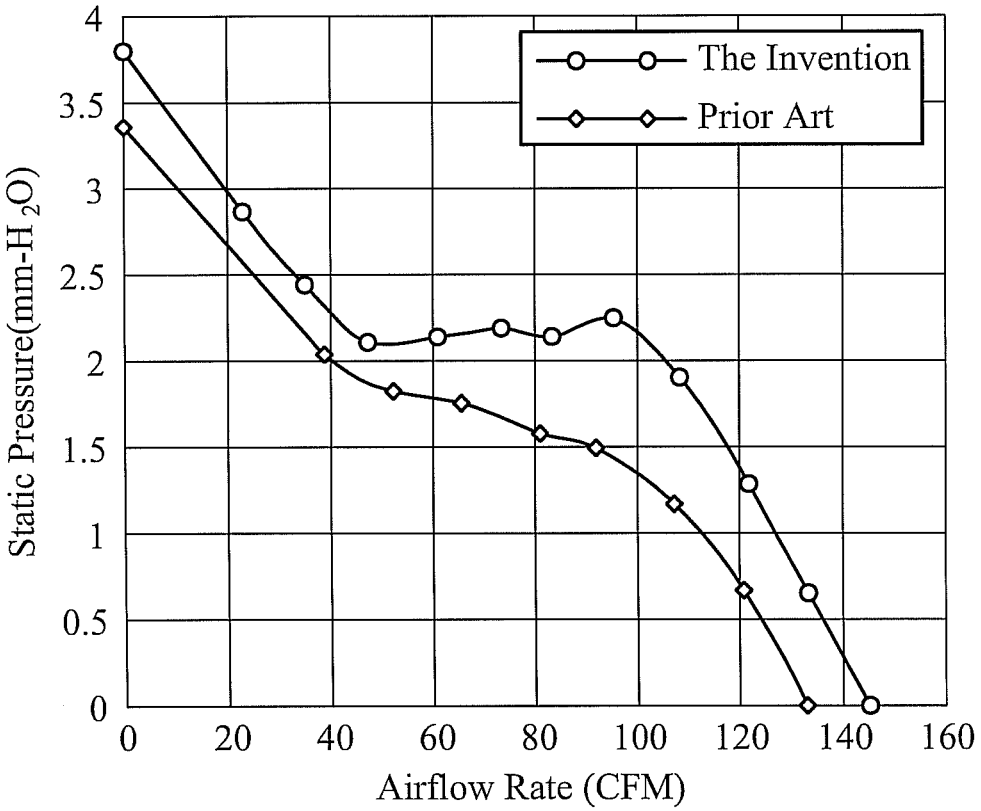
FIG. 4 is a schematic diagram showing efficiency curves of a conventional axial fan and an axial fan according to the embodiment of the present invention.

FIG. 4 is a schematic diagram showing efficiency curves of a conventional axial fan and an axial fan according to the embodiment of the present invention. In the embodiment of the present invention, the guiding elements 23 are provided to solve the problem of the flow field arising from the vortex produced at the airflow outlet 27 of the fan 2. Thus, pressure and velocity of the airflow is raised to enhance the overall performance of the fan 2 (as marked in FIG. 4). Moreover, the guiding elements 23 can be assembled by various designs to expand the applicable scope of the fan 2.

While the present invention has been described by way of example and in terms of preferred embodiment, it is to be understood that the present invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A frame, comprising:

a main body having an airflow inlet and an airflow outlet; and a plurality of guiding elements disposed in the main body and located at the airflow outlet, wherein each of the guiding elements comprises an inclined part and an axial extended part, and the inclined part meets the axial extended part at an angle;

wherein the inclined part has a first height, the axial extended part has a second height, and a ratio of the first height to the second height is between 0.2 and 5;

wherein the axial extended part of each of the guiding elements guides airflow away from the frame in a direction perpendicular to a radial direction of the airflow outlet, and the axial extended part is parallel to a vertical direction of the airflow outlet, and wherein the sum of the first height and the second height exceeds 15 millimeters when the frame is sized as 38×38 millimeters.

2. The frame as claimed in claim 1, wherein the angle is between 20 degrees and 50degrees.

3. The frame as claimed in claim 1, wherein the axial extended part is parallel to a vertical direction of the frame or the axial extended part inclines to the axis of the frame by an clipping angle which is smaller than or equal to 20 degrees.

4. The frame as claimed in claim 1, wherein a cross-section of the inclined part is wing shaped, arc-shaped or streamline-shaped.

5. The frame as claimed in claim 1, wherein the inclined part and the axial extended part are integrally formed as a single piece.

6. The frame as claimed in claim 1, wherein the inclined part and the axial extended part are different components and combined to form the guiding element.

7. The frame as claimed in claim 1, further comprising a motor base connected to the main body via the guiding elements, and wherein the motor base has at least one protruding rib inside the motor base.

8. The frame as claimed in claim 1, wherein the main body is substantially rectangular, rounded, elliptic, polygonal or cone-shaped.

9. A fan, comprising:

a frame, comprising:

a main body having an airflow inlet and an airflow outlet;

a plurality of guiding elements disposed in the main body and located at the airflow outlet;

a motor base connected to the main body; and an impeller disposed on the motor base for providing airflow;

wherein each of the guiding elements comprises an inclined part and an axial extended part, the inclined part meets the axial extended part at an angle, the inclined part has a first height, the axial extended part has a second height, and a ratio of the first height to the second height is between 0.2 and 5, and the axial extended part of each of the guiding elements guides the airflow away from the fan in a direction perpendicular to a radial direction of the airflow outlet, and the axial extended part is parallel to a vertical direction of the airflow outlet, and wherein the sum of the first height and the second height exceeds 15 millimeters when the frame is sized as 38×38 millimeters.

10. The fan as claimed in claim 9, wherein the angle is between 20 degrees and 50 degrees.

11. The fan as claimed in claim 9, wherein the axial extended part is parallel to a vertical direction of the frame or the axial extended part inclines to the axis of the frame by a clipping angle which is smaller than or equal to 20 degrees.

12. The fan as claimed in claim 9, wherein a cross-section of the inclined part is wing shaped, arc-shaped or streamline-shaped.

13. The fan as claimed in claim 9, wherein the inclined part and the axial extended part are integrally formed as a single piece.

14. The fan as claimed in claim 9, wherein the inclined part and the axial extended part are different components and combined to form the guiding element.

15. The fan as claimed in claim 9, wherein the main body is substantially rectangular, rounded, elliptic, polygonal or cone-shaped.

* * * * *